US011970794B2

(12) United States Patent
Mack et al.

(10) Patent No.: US 11,970,794 B2
(45) Date of Patent: Apr. 30, 2024

(54) YARN TREATMENT DEVICE AND METHOD

(71) Applicant: Vandewiele nv, Kortrijk (BE)

(72) Inventors: Andreas Mack, Elfershausen (DE); Ralf Ertl, Bad Kissingen (DE)

(73) Assignee: Vandeweile nv (BE)

( * ) Notice: Subject to any disclaimer, the term of this patent is extended or adjusted under 35 U.S.C. 154(b) by 970 days.

(21) Appl. No.: 16/753,125

(22) PCT Filed: Oct. 4, 2018

(86) PCT No.: PCT/DE2018/100828
§ 371 (c)(1),
(2) Date: Aug. 6, 2020

(87) PCT Pub. No.: WO2019/068290
PCT Pub. Date: Apr. 11, 2019

(65) Prior Publication Data

US 2020/0362487 A1 Nov. 19, 2020

(30) Foreign Application Priority Data

Oct. 5, 2017 (DE) ..... 10 2017 009 256.7

(51) Int. Cl.
*D02J 1/08* (2006.01)

(52) U.S. Cl.
CPC ..... *D02J 1/08* (2013.01)

(58) Field of Classification Search
CPC .. D02J 1/08; D02G 1/16; D02G 1/161; D02G 1/162
See application file for complete search history.

(56) References Cited

U.S. PATENT DOCUMENTS

| | | | | | |
|---|---|---|---|---|---|
| 112,651 | A * | 3/1871 | Lindsley | D02G 1/162 | 57/6 |
| 3,093,878 | A * | 6/1963 | Fieldman | D02G 1/162 | 57/208 |
| 4,223,520 | A * | 9/1980 | Whitted | D02G 1/162 | 57/208 |
| 4,596,115 | A * | 6/1986 | Maeda | D02G 1/085 | 57/908 |
| 5,134,840 | A * | 8/1992 | Niederer | D02G 1/162 | 57/236 |

(Continued)

FOREIGN PATENT DOCUMENTS

| | | |
|---|---|---|
| CN | 206308461 U | 7/2017 |
| DE | 4140469 A1 | 6/1993 |

(Continued)

*Primary Examiner* — Jillian K Pierorazio
(74) *Attorney, Agent, or Firm* — Frank H. Foster; Kremblas & Foster

(57) ABSTRACT

The invention relates to a yarn treatment device for intermingling multifilament yarns by means of a pulsating air stream that is generated by a rotating cup ring having openings, characterized in that the drive motor and the support of the cup ring are located in the interior of the housing with the air supply channels thereof, and to a yarn treatment device for intermingling multifilament yarns by means of a pulsating air stream that is generated by a rotating cup ring having openings, characterized in that one or more nozzle inserts, through which the pulsating blown air flows, per thread run are arranged on the housing cup.

14 Claims, 3 Drawing Sheets

(56) References Cited

U.S. PATENT DOCUMENTS 5,324,905 A * 6/1994 Arnosti ..... D02J 13/005 219/645
5,619,849 A * 4/1997 McNeill ..... D02G 3/343 57/328
5,673,549 A * 10/1997 McNeill ..... D02J 1/08 57/328
6,069,426 A * 5/2000 Baader ..... H02K 7/14 226/188
6,441,353 B1 * 8/2002 Gehrmann ..... D02J 1/22 226/188
2012/0144633 A1 * 6/2012 Kaulitzki ..... D02J 1/06 28/240
2013/0247341 A1 * 9/2013 Stundl ..... D02J 1/06 28/271
2013/0263414 A1 * 10/2013 Kaulitzki ..... D02G 1/162 28/274
2014/0068902 A1 * 3/2014 Matthies ..... D02G 1/162 28/271
2014/0077408 A1 * 3/2014 Stundl ..... D01D 10/00 264/103
2014/0090220 A1 * 4/2014 Matthies ..... D02J 1/08 28/274
2014/0103648 A1 * 4/2014 Matthies ..... D04G 5/00 289/2
2014/0250646 A1 * 9/2014 Stundl ..... D02G 1/161 28/271

FOREIGN PATENT DOCUMENTS

DE 10122973 A1 11/2001
JP H07218130 A 8/1995

* cited by examiner

YARN TREATMENT DEVICE AND METHOD

BACKGROUND OF THE INVENTION

The invention relates to a device for air intermingling multifilament yarns according to the preambles of claims 1 and 11. The invention further relates to a yarn treatment method, particularly by means of the yarn treatment device.

Intermingling nozzles for multifilament yarns are sufficiently known and are used for spinning non-textured yarns (such as FDY, POY, IDY), glass fibers, and carpet yarns (BCF), on texturing machines and winding machines. They produce the thread cohesion required for further processing in that the filaments are knotted together at specific intervals. In some cases, the yarn is given a desired structure by said knot formation. In BCF yarns, particularly in tri-color yarns, the intensity and characteristics of intermingling decisively contribute to the color appearance and structure of a carpet. Intermingling devices are available in single-thread and multi-thread designs.

Conventional intermingling nozzles operate on static compressed air, which flows through one or more blow holes into a yarn channel through which the thread runs. This causes the filaments to become entwined, forming so-called intermingling knots, hereinafter also referred to as knots. The number, intensity, uniformity, and spacing of the knots substantially depend on the yarn and its yarn thickness and number of filaments, on the design of the intermingling nozzles and the geometries of the yarn channel and blow hole, and on process parameters such as yarn speed, filament angle, thread tension, and intermingling pressure.

The number of knots, intensity, and uniformity of intermingling can be set to some extent only herein. But there are intermingling nozzles into which the intermingling air flows in a pulsating manner. In these embodiments, the intermingling air is sequentially interrupted by a rotating ring in which the air passages are located. The number of knots can be defined in this case by the rotor speed and the number and spacing of the air passages at the respective thread speed.

U.S. Pat. No. 4,949,440 presents a device in which the intermingling air flows into a rotating cup which has holes on its outer periphery. The cup is mounted on 2 grooved ball bearings, and a pulley which drives the cup is located at the outer end of the cup. When the opening in the cup is above the intermingling opening in the housing, intermingling air flows into the intermingling chamber, and the air pulse twists the filaments of the supplied yarn, and knots are forming at a frequency which results from the yarn speed, the cup speed, and the number of openings in the cup.

EP 2 721 203 likewise presents such a device, in which the intermingling air flows through the blow hole openings in a rotating cup which has thread grooves cut into its periphery. When the hole is located above the pressure chamber, air flows through it onto the thread, and a knot is formed. The drive of the cup is carried out by means of an electric motor which is located outside the intermingling device.

Both devices mentioned above have the disadvantage that the drive of the cup is located outside the device, such that the device requires much installation space. In addition, considerable forces, which are emphasized by the compressed air, are acting on the bearing of the cup due to the open design, which bearing therefore must be dimensioned sufficiently large, which increases the space requirement, power demand, and also the production costs. The available space for the intermingling device is limited, particularly in older textile plants, such that it is impossible or difficult to implement a switch to the pulsating air intermingling technology.

It is the problem of the invention to configure an intermingling device using pulsating blow air for generating the knots in such a manner that the assembly is compact and the intermingling process can be carried out with as little power demand as possible. This problem is solved by means of the yarn treatment device referenced in claims 1 and 11 and the method claims 14 and 15. The dependent claims disclose advantageous embodiments of the invention.

SUMMARY OF THE INVENTION

According to the invention, the bearing of the rotating cup and the drive motor of the shaft on which the rotating cup is seated are integrated into the housing of the intermingling device. The motor is preferably a synchronous electric motor in which the rotor is firmly connected to the shaft on which also the rotating cup is seated and in which the stator is firmly seated in the housing of the device. Motor housing, motor bearing, and shaft coupling can thus be eliminated. The device substantially consists of the following units: Base housing which receives the stator, bearing outer races and chambers for supplying the compressed intermingling air, shaft with rotor, rotation cup with holes for pulsating the blow air and housing around the rotation cup with openings for the rotating blow air or for a nozzle insert with a stationary blow channel. The thread is inserted into the intermingling or yarn channel, either through a slot or by means of an open-and-close unit which is opened for thread placing and closed for intermingling. The intermingling air flows into the housing via a feed line through a chamber which is disposed around the stator of the electric motor to the openings provided radially on the outer periphery. The intermingling air flowing through is at the same time used for cooling the motor. The rotating cup rotates about the housing with a minimal sealing gap, and the blow air flows in a pulsating manner through the opening in the cup. The openings, through which the compressed air exits, are provided as well on the opposite side in the housing. But no air flows out here, the air pressure is static. Because these holes are provided on opposing sides, they cause the compressed air forces, which act radially on the cup and the bearing to almost cancel each other out.

A housing is disposed around the rotating cup, which completely encloses the cup and has openings only in the yarn intermingling area, through which the pulsating blow air can flow. The gap between the rotating cup and the cup housing is at least configured such that the cup can rotate freely but only minimal quantities of compressed air can escape into the opening of the cup. Two different systems are implemented here.

In a system having a stationary blow hole, one or more, preferably two, openings are located radially on the circumference of the housing cup, to which openings nozzle inserts with blow holes for intermingling are attached. Opening slots are disposed radially on the periphery of the rotating cup and in one plane with the openings of the housing, and they let the compressed air flow in a pulsating manner into the blow hole of the nozzle insert. The spacing of the openings from each other along the periphery is preferably dimensioned such that the intermingling air flows through the openings in an alternately pulsating manner in accordance with the spacing of the opening slots in the housing cup. The yarn receives a first intermingling pulse when entering the first nozzle body and a second pulse when passing through the second nozzle body. The rotational speed of the rotor is preferably set such that the second pulse acts in the middle between the knots formed by the first pulse. The second pulse reinforces the knots already formed by the first pulse. This embodiment has the advantage compared to the tandem nozzles typically used in practice (two nozzle inserts connected in series), in which blow air flows continuously, that the air consumption is reduced almost by half, since there is always mainly just one blow hole in use. The pulses from the respective blow hole generate the intermingling knot, and only the air needed for forming a knot is used. The uniformity of the knot spacings increases as well, and the length and number of non-intermingled spots decreases. In the tandem embodiment of the device with two nozzle inserts, one nozzle insert can be set inactive if the pulse of a single nozzle insert is sufficient for the desired intermingling, which reduces the intermingling air and the power demand needed by half once again.

The spacings between the blow holes in the case of two or more nozzle inserts are preferably selected such that the yarn length between two blow holes is the 1.5-fold of the primarily preferred knot spacing. For example, the yarn length between blow holes is 50 mm for desired 30 knots/m, which corresponds to a knot spacing of 33.3 mm. The hole spacings can be defined to a specific measure, but it is also an option to intermingle the yarn using two nozzle inserts having different hole spacings.

An additional means to specify the frequency of intermingling knots is the number and spacing of the openings in the rotor. The nozzle inserts with their respective sizes in the yarn channels and blow holes can be exchanged. Another option is to determine pulses in both blow holes at the same time. The number, spacing, and length of the openings in the rotor can be used to set any desired intermingling structures from stable, uniform intermingling at even spacings to uneven intermingling at uneven spacings but with a certain regularity, allowing a yarn manufacturer to reflect a broad spectrum.

In the other system in which the blow hole rotates, a longitudinal slot is disposed radially in the housing in one plane with the rotating blow hole. The blow hole is located in a rotating cup. The spacing between the rotor cup and the cup housing is dimensioned such that there is no contact between the rotating and the stationary cup wall even at high rotational speeds, and as little blow air as possible can escape. The thread runs at a speed across the longitudinal slot. The blow air flows from the rotating blow hole onto the running thread into the yarn channel and generates an intermingling knot in the area of the longitudinal slot. The frequency at which the intermingling knot is generated depends on the rotational speed of the rotating cup and the number of holes as well as on the spacing of the holes, which are disposed radially along the periphery. The rotor speed preferably matches the yarn speed.

The spacing, number, and diameter of the blow holes in the rotor cup are specified based on the yarn titer and intermingling requirements, and the rotor can be exchanged as required. For example, a specific number of rotor holes can be disposed evenly, but also unevenly at different spacings to achieve various effects. Like in conventional intermingling nozzles, the diameter or shape of the rotor holes can be cylindrical, elliptical, or y-shaped.

Both systems mentioned above can be configured for multi-thread textile machines in which the threads are disposed in parallel next to each other and will then have a plurality of the openings mentioned above in parallel next to each other in the axial direction.

The intermingling unit is sealed from the outside, and intermingling air can only escape in the intermingling zone. The rotating cup has a minimal sealing gap towards the outside and the inside. Due to the special arrangement and design of the air channels, the forces generated by the compressed air and acting on the rotating cup almost cancel each other out. This means that the bearing and rotor cup wall can be minimized, resulting in very compact dimensions.

The invention is a yarn treatment device for intermingling multifilament yarns by means of a pulsating air stream which is generated by means of a rotating cup ring having openings, wherein the drive motor and the bearing of the cup ring are located in the interior of the housing with its air supply channels.

In an optional further development of this idea, the drive of the rotor cup is an electric drive in which the rotor of the electric motor is fastened onto the shaft and the stator is seated in the housing.

The housing preferably has recesses in the area of the electric motor for motor cooling by means of circulating intermingling air.

Furthermore, additional air outlet holes can be located in the housing, which almost cancel out the radial forces the compressed air applies to the bearing.

According to an optimal embodiment of the invention, the rotor cup is enclosed by a housing cup with openings for the exit of the pulsating blow air.

Alternatively, or in addition, the invention is a yarn treatment device for intermingling multifilament yarns by means of a pulsating air stream, which is generated by a rotating cup ring having openings, wherein one or more nozzle inserts through which inserts blow air flows are disposed per thread run on the housing cup.

In the process, two nozzle inserts in a tandem arrangement can intermingle one thread each.

This results in the advantageous procedure that the blow air pulse is caused to flow through one of the blow holes in an alternately pulsating manner, or that the blow air pulse is caused to flow through both blow holes simultaneously in a pulsating manner.

It has proved useful in practice that the spacing between holes is in the range from 30 mm to 70 mm.

Exemplary embodiments are explained in detail in the drawings and figures below.

DETAILED DESCRIPTION OF THE INVENTION

List of Reference Numerals

Figure 1:
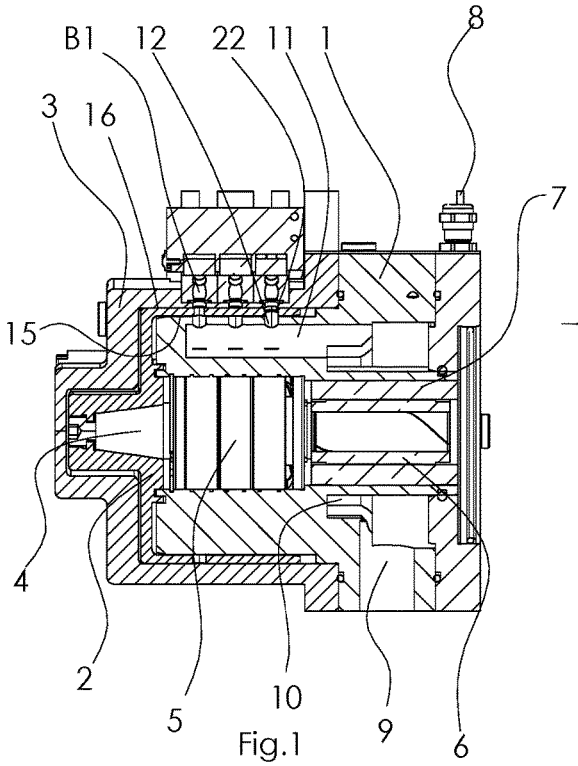
FIG. 1 shows a cross section through a device with a stationary blow hole

1. Housing
2. Rotor cup
3. Pot-type case
4. Shaft
5. Bearing
6. Motor rotor
7. Motor stator
8. Motor line
9. Opening for blow air supply
10. Annular recess for air cooling
11. Air supply channel
12. Air outlet chamber
13. Thread guide
14. Rotor blow hole
15. Sealing gap between rotor and housing
16. Sealing gap between rotor and rotor cup
17. Yarn channel
18. Yarn channel insert
19. Housing slot
20. Opening and closing device
21. Thread
22. Rotor opening
23. Baffle plate
24. Yarn channel
25. Housing passage
26. Nozzle insert
27. Thread guide sheet
28. Threading slot
29. Intermingling knot
30. Open spot
31. Thread guide pin
B1 Blow hole 1
B2 Blow hole 2
OL Slot length
BA Hole spacing
KA Knot spacing

EXAMPLES

FIG. 1 describes a 3-thread intermingling device having stationary blow holes in a tandem arrangement, shown in cross section. An opening 9 for the blow air supply is located in the housing 1. The blow air flows through an annular recess 10 through the air supply channel 11 into the air outlet chambers 12 and is present at a specific air pressure. The air outlet chambers 12 are opened or closed by the rotating rotor 2 based on position. The blow hole B1 is located on the opposite side of the air outlet chambers 12. When the rotor opening 22 is above the air outlet chamber, compressed air flows through the rotor opening 22 into the blow hole B1 of the nozzle insert. The rotor cup 2 is seated on a shaft 4 and driven by an integrated electric motor. This motor consists of a stator 7, which is mounted into the housing 1, and a rotor 6, which is firmly seated on the shaft 4. The shaft 4 is mounted in a bearing package 5 at its inner diameter. The outer diameter of the bearing 5 is seated in the housing 1. Power is supplied by a cable 8, which is conducted to the outside. The sometimes considerable axial forces which are present due to the air pressure inside the system are almost eliminated by the closed status of the system, since pressure is applied evenly to opposing surfaces.

Figure 2:
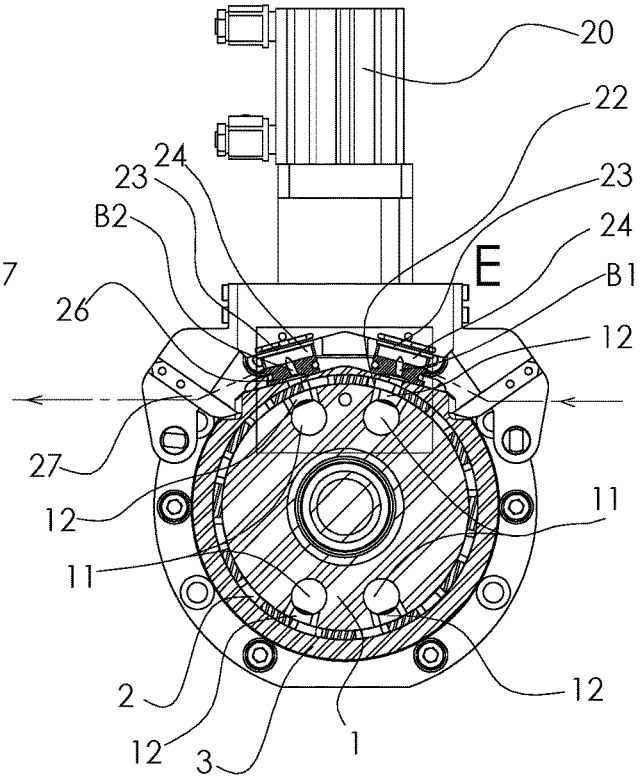
FIG. 2 shows a cross section through the longitudinal axes of the yarn channels of a device with a stationary blow hole

FIG. 2 shows the tandem arrangement in a cross section through the axis of the yarn channels 24 of the nozzle inserts. The rotor cup 2 can be seen as a ring in cross section with its openings 22. The air supply channels 11 and air outlet chambers 12 are visible in the housing 1. Two chambers 12 are disposed opposite the blow holes B1 and B2, two chambers 12 are in a mirrored position on the bottom side of the housing 1. These make it possible to almost eliminate the forces which act radially due to the air pressure onto the rotor cup 2 at the air outlet chambers 12. The view represented shows the device with a pneumatic cylinder 20, which opens the baffle plates 23 terminating the yarn channels 24 and the thread guide sheets 27 with the thread guides (not shown) for thread placing and closes them again for intermingling.

Figure 3:
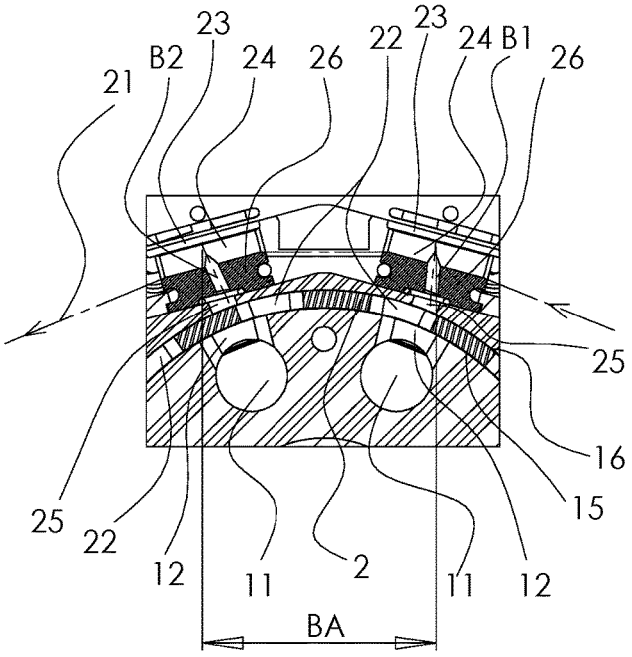
FIG. 3 shows excerpt E of FIG. 2

FIG. 3 shows an excerpt of the nozzle body arrangement in a cross section through the longitudinal axis of the yarn channel 24. In the position of the rotor cup 2 shown, compressed air is applied to the blow hole B1. The compressed air flows from the air outlet chamber 12 through the rotor opening 22 into the blow hole B1 and generates an air pressure pulse acting on the yarn 21, which runs through the yarn channel 24. In the subsequent nozzle insert 26 with the blow hole B2, the air supply is closed by the rotor cup 2. It will be opened when the rotor opening 25 is located above the blow hole B2 after turning the rotor cup and the present compressed air also generates a compressed air pulse acting on the yarn 21. At the same moment, the blow hole B1 is closed. The spacing BA of the blow holes is preferably dimensioned such that the yarn length between the two blow holes corresponds to a factor 1.5 of the distance selected between two intermingling knots. It is preferably between 30 and 70 mm. The spacing of the rotor openings is selected such that compressed air is preferably applied to only one of the blow holes. To enable the rotor cup to rotate freely without making contact with the material of the housing 1 or the housing cup 3, the respective diameters are configured to create a gap 15 and 16 between the stationary parts and the rotating cup. The gap, however, is minimized to ensure that as little compressed air as possible can flow into the blow holes when the blow channel is closed by the rotor wall.

Figure 4:
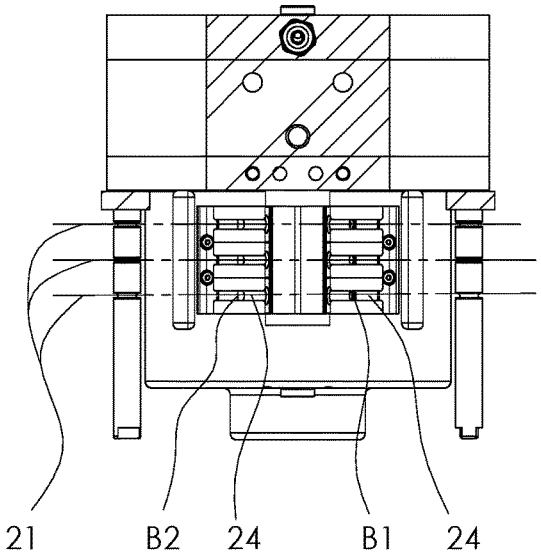
FIG. 4 shows a top view of a cross section through FIG. 2

FIG. 4 shows a top view of a cross section through the intermingling device when opened for thread placing. 3 thread runs 21 and the open yarn channels 24 as well as the blow holes B1 and B2 are visible.

Figure 5:
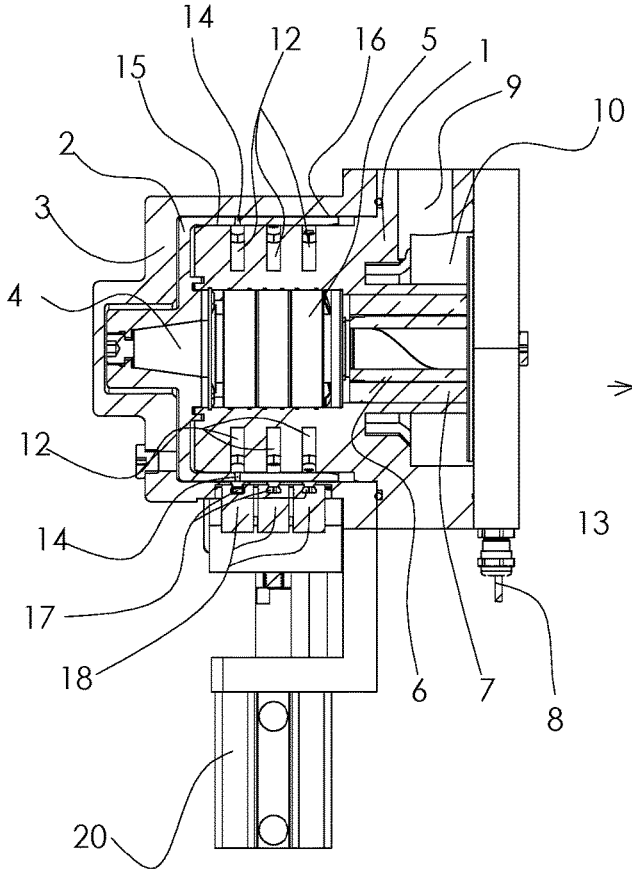
FIG. 5 shows a cross section through a device with a rotating blow hole

FIG. 5 describes a 3-thread intermingling device having a rotating blow hole, shown in cross section. The internal structure is similar to that of FIG. 1. An opening 9 for the blow air supply is located in the housing 1. The blow air flows through an annular recess 10 through the air supply channels 11 into the air outlet chambers 12 and is present at a specific air pressure. The air outlet chambers 12 are opened or closed by the rotating rotor 2 based on position. Unlike FIG. 1, the blow hole 14 is located in the rotor. When the rotor blow hole is above the air outlet chamber 12 on the side of the yarn channel 17, compressed air flows through the rotor blow hole 14 into the yarn channel 17. The yarn channel insert 18 is opened for placing the thread and closed for intermingling by means of the pneumatic cylinder 20. An open variant (not shown) in which the thread is threaded through a slot is also conceivable here.

The air outlet chambers are arranged at a 180° offset in this case as well and reduce the considerable radial forces which act on the bearing. The sometimes considerable axial forces which are present due to the air pressure inside the system are almost eliminated by the closed status of the system as described in FIG. 1, since pressure is applied evenly to opposing surfaces.

Figure 6:
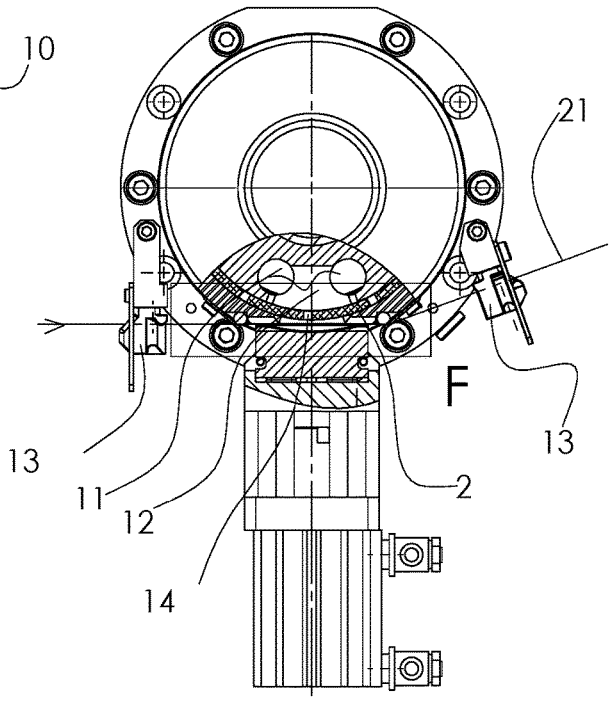
FIG. 6 shows a cross section through the longitudinal axes of the yarn channel of a device with a rotating blow hole

FIG. 6 shows the device with a rotating blow hole in a cross section through the longitudinal axis of the yarn channel insert 18. The compressed air passes through the air supply channel 11 into the air outlet chamber. When the rotor hole 14 is above the air outlet chamber 12 and the housing slot 19, compressed air can pass through the rotor hole 14.

Figure 7:
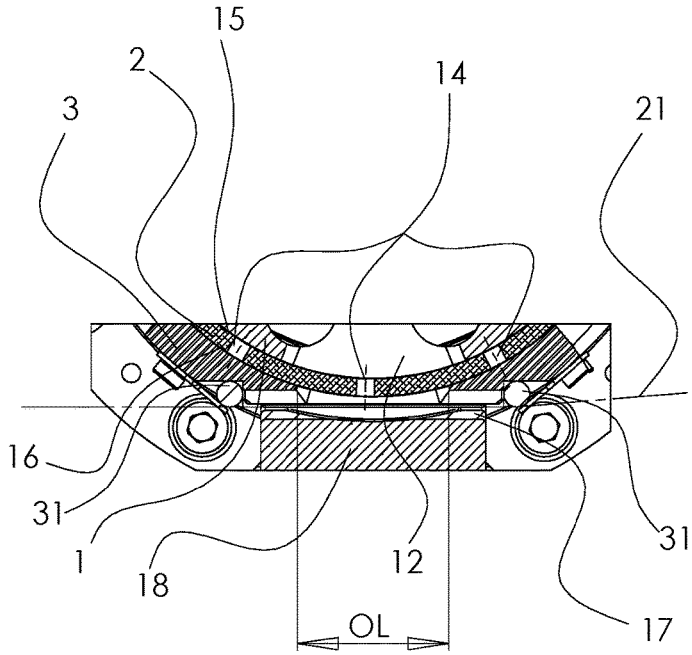
FIG. 7 shows excerpt F from FIG. 6

FIG. 7 shows an enlarged portion of FIG. 6. The rotor hole 14 is in the area of the air outlet chamber 12, and the blow air flows into the yarn channel 17 in the area of the opening slot OL. The yarn 21 which passes through the yarn channel 17 receives a compressed air pulse through the rotor hole 14 when it enters the opening slot, until the rotor hole 14 dips into the housing 1 again. The length of the opening slot OL preferably corresponds to the desired spacing of the intermingling knots, e.g. 33 mm of slot opening length for desired 30 knots/m. The speed of the rotor cup 2 at the outer diameter preferably matches the yarn speed through the device. The thread 21 runs across thread guide pins 31, which prevent it from coming into direct contact with the rotor cup 2 or the housing 1.

Figure 8:
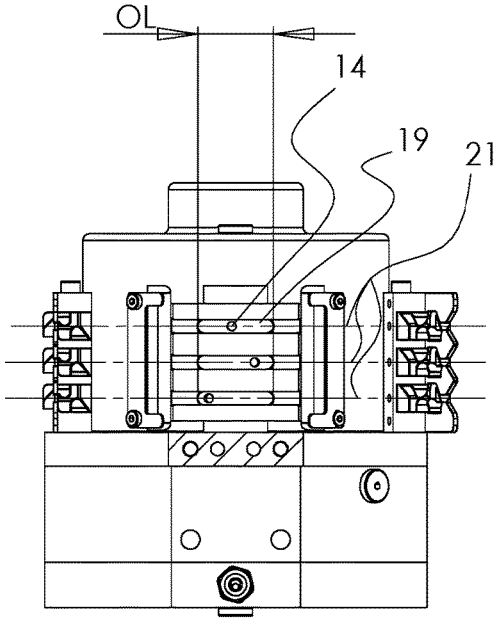
FIG. 8 shows a bottom view of a cross section through FIG. 6

FIG. 8 shows a cross section through the device which is opened for thread placing. Visible are the three opening slots 19 and the rotor holes 14, which are disposed at a radial offset from each other. The offset arrangement helps distribute pulse forces which act on the rotor cup 2 and the bearing 5.

Figure 9A:
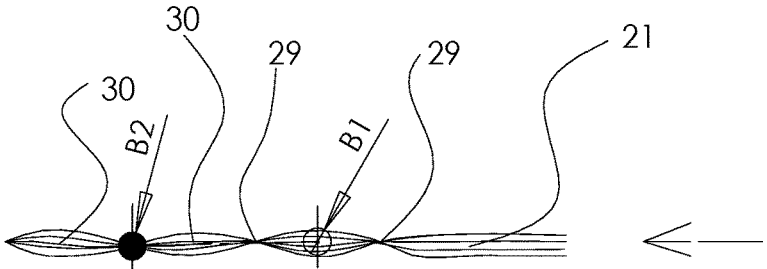
FIG. 9*a* shows a yarn with intermingling knots

FIG. 9*a* shows a schematic view of the operation of a tandem arrangement. The as yet non-intermingled thread 21 receives an intermingling pulse from the blow hole B1, and an intermingling knot 29 forms upstream and downstream of the blow hole B1. At the same time, the blow hole B2 is closed. There is an open spot 30 between the two knots 29.

Figure 9B:
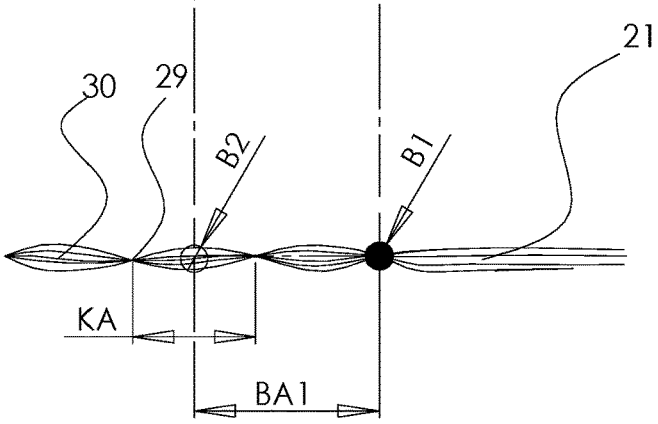
FIG. 9*b* shows a yarn with intermingling knots

In FIG. 9*b*, the blow hole B1 is now closed and the blow hole B2 is open. The spacing of the blow holes BA is dimensioned such that the intermingling pulse of the blow hole B2 preferably creates the open spot 30 between two intermingling knots 29 and thus once again generates the knots 29. Ideally, the blow hole spacing is 1.5 times the knot spacing and should be in the range from 1.2 to 1.8 times the knot spacing.

Figure 10A:
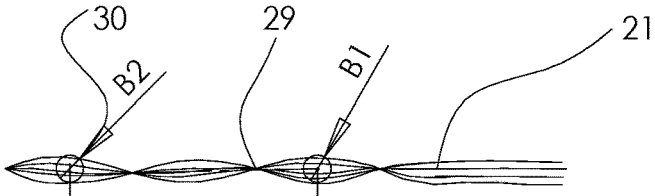
FIG. 10*a* shows a yarn with intermingling knots

FIG. 10*a* shows an arrangement in which the intermingling pulse is given at the same time from the blow holes B1 and B2. The pulse from blow hole B2 is directed into the open spot.

Figure 10B:
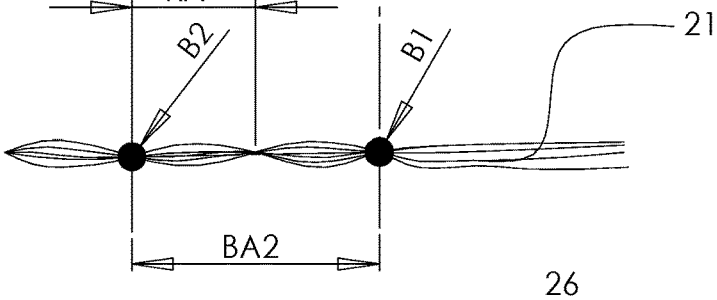
FIG. 10*b* shows a yarn with intermingling knots

FIG. 10*b* shows the arrangement when the air is supplied at the same time. The spacing of the blow holes BA preferably is 2 times the knot spacing and should be in the range from 1.7 to 2.3.

Figure 11:
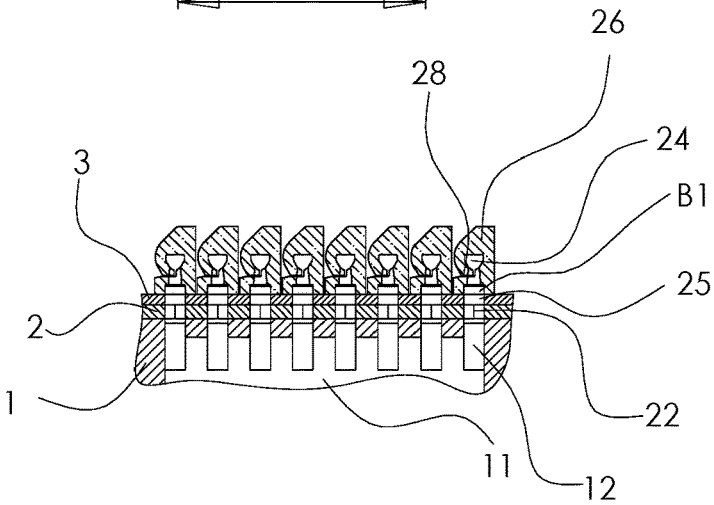
FIG. 11 shows a multi-thread intermingling block

FIG. 11 shows a multi-thread intermingling block. The nozzle inserts 26 have a threading slot 28 for placing the thread in the yarn channel 24. The intermingling air flows from the air supply channel 11 into the air outlet chamber 12, then through the rotor opening 22 and the blow hole 25 into the yarn channel. This arrangement can also be implemented using two or more nozzle inserts connected in series. Furthermore, a similar variant (not shown) with an open threading slot can be implemented in a single nozzle.

The variant with open nozzle inserts for threading without extra mechanisms is particularly used in spinning processes in which the machine operators are not used to opening and closing mechanisms.

The invention claimed is:

1. A yarn treatment device for intermingling multifilament yarns by means of a pulsating air stream generated by an orifice ring (2) rotating or rotatable by means of a drive motor, having one or more openings (22) for blow air, characterized in that the drive motor is located in the interior of a base housing (1).

2. The yarn treatment device according to claim 1, wherein the base housing (1) comprises air inlet channels or air supply channels (11).

3. The yarn treatment device according to claim 1, wherein the orifice ring (2) has a bearing (5) which is disposed in the interior of the base housing (1).

4. The yarn treatment device according to claim 1, wherein, for rotation about the base housing (1), the orifice ring (2) is disposed having an inner sealing gap (15) relative to the base housing (1).

5. The yarn treatment device according to claim 1, wherein a drive of the orifice ring (2) is an electric drive with an electric motor in which a rotor (6) of the electric motor is fastened on a shaft (4) on which the orifice ring (2) is seated, and a stator (7) of the electric motor is seated in the base housing (1).

6. The yarn treatment device according to claim 1, wherein one or more recesses (10) are located in the base housing (1) in the area of the electric motor, which recesses are configured for cooling the electric motor by means of circulating intermingling air flowing into the openings provided radially on the outer periphery.

7. The yarn treatment device according to claim 3, wherein additional air outlet holes or chambers (12) are disposed in the base housing (1) in such a manner that radial forces of the compressed air acting on the bearing (5) are completely or partially eliminated.

8. The yarn treatment device according to claim 1, wherein the orifice ring (2) is enclosed by a housing cup (3) having openings for the exit of the pulsating blow air.

9. The yarn treatment device according to claim 8, wherein the housing cup (3) is disposed around the orifice ring (2) with an outer sealing gap (16) to the orifice ring (2) which is configured so that the orifice ring (2) can be freely rotated and only minimal quantities of compressed air can escape through the outer sealing gap (16).

10. A yarn treatment device for intermingling multifilament yarns by means of a pulsating air stream generated by an orifice ring (2) rotating or rotatable by means of a drive motor having one or more openings (22) for blow air, wherein said orifice ring (2) is enclosed by a housing cup (3), characterized in that openings (25) for the exit of the pulsating air stream or the blow air or one or more nozzle inserts (26) per thread run, through which the pulsating air stream or the blow air flows, are disposed on the housing cup (3).

11. The yarn treatment device according to claim 10, wherein two nozzle inserts (26) are disposed in a tandem arrangement for intermingling one thread (21) each.

12. The yarn treatment device according to claim 11, wherein spacing of blow holes (B1, B2) of the nozzle inserts (26) is between 30 mm and 70 mm.

13. A method for yarn treatment by intermingling multifilament yarns by means of a pulsating air stream, which exits from one respective blow hole (B1, B2) of multiple nozzle inserts (26) and applies an intermingling pulse to an as yet non-intermingled thread (21), wherein the thread (21) forms an intermingling knot (29), and multiple nozzle inserts (26) are used in a tandem arrangement, wherein the nozzle inserts (26) are fixed in the thread run direction, one behind another, at a non-rotating housing cup (3), and an intermingling or blow air pulse is alternately applied to the thread (21) in a pulsating manner from the blow hole (B1, B2) of one of the nozzle inserts (26), respectively.

14. A method for yarn treatment by intermingling multi-filament yarns by means of a pulsating air stream, which exits from one respective blow hole (B1, B2) of multiple nozzle inserts (26) and applies an intermingling pulse to an as yet non-intermingled thread (21), wherein the thread (21) forms an intermingling knot (29), and multiple nozzle inserts (26) are used in a tandem arrangement, the nozzle inserts (26) are fixed in the thread run direction, one behind another, at a non-rotating housing cup (3), and intermingling or blow air pulses are simultaneously applied to the thread (21) in a pulsating manner from the blow holes (B1, B2) of the nozzle inserts (26).

* * * * *